US009051732B2

(12) United States Patent
Ting

(10) Patent No.: US 9,051,732 B2
(45) Date of Patent: Jun. 9, 2015

(54) INTERMEDIATE DIVIDER WITHIN AN EXTERIOR WALL UNIT

(71) Applicant: Advanced Building Systems, Inc., Wilmington, DE (US)

(72) Inventor: Raymond M. L. Ting, Pittsburgh, PA (US)

(73) Assignee: Advanced Building Systems, Inc., Wilmington, DE (US)

( * ) Notice: Subject to any disclaimer, the term of this patent is extended or adjusted under 35 U.S.C. 154(b) by 0 days.

(21) Appl. No.: 14/188,848

(22) Filed: Feb. 25, 2014

(65) Prior Publication Data

US 2014/0237921 A1 Aug. 28, 2014

Related U.S. Application Data

(60) Provisional application No. 61/769,036, filed on Feb. 25, 2013.

(51) Int. Cl.
*E04H 1/00* (2006.01)
*E04B 2/88* (2006.01)

(52) U.S. Cl.
CPC ..... *E04B 2/88* (2013.01)

(58) Field of Classification Search
CPC ..... E04B 2/88; E04B 2/96; E04B 2/90; E04B 2/92; E04B 2/965; E04B 2/967; E04B 1/6812; E06B 7/14; E06B 7/26; E06B 3/4609; E06B 1/62
USPC ..... 52/235, 204.1, 204.5, 204.51, 207, 209, 52/656.2, 656.5, 656.6, 204.591
See application file for complete search history.

(56) References Cited

U.S. PATENT DOCUMENTS

| | | | | |
|---|---|---|---|---|
| 3,785,090 | A * | 1/1974 | MacGillis | 49/425 |
| 4,229,905 | A * | 10/1980 | Rush | 49/143 |
| 4,561,225 | A | 12/1985 | Gartner | |
| 4,685,263 | A | 8/1987 | Ting | |
| 4,765,107 | A | 8/1988 | Ting | |
| 4,840,004 | A | 6/1989 | Ting | |
| 4,873,805 | A | 10/1989 | Ting | |
| 5,452,552 | A | 9/1995 | Ting | |
| 5,596,851 | A | 1/1997 | Ting | |
| 5,598,671 | A | 2/1997 | Ting | |
| 5,687,524 | A | 11/1997 | Ting | |
| 6,393,778 | B1 | 5/2002 | Ting | |
| 6,591,562 | B2 | 7/2003 | Ting | |
| 6,598,361 | B2 | 7/2003 | Ting | |
| 7,134,247 | B2 | 11/2006 | Ting | |
| 7,246,466 | B2 * | 7/2007 | Turner | 49/504 |
| 8,001,738 | B2 | 8/2011 | Ting | |

(Continued)

FOREIGN PATENT DOCUMENTS

WO WO01-81686 11/2001

OTHER PUBLICATIONS

Choi, Hyun Goo, Notification of Transmittal of the International Search Report and the Written Opinion of the International Searching Authority, or the Declaration, May 14, 2014, PCT Serial No. PCT/US2014/018229.

*Primary Examiner* — Mark Wendell
(74) *Attorney, Agent, or Firm* — Beck & Thomas, P.C.

(57) ABSTRACT

An intermediate divider system for an exterior wall unit. The intermediate divider system allows for flexibility in aesthetic design of the exterior wall grid line pattern, while maintaining both wind load resistance and water-tightness performance.

10 Claims, 5 Drawing Sheets

(56) References Cited

U.S. PATENT DOCUMENTS

| | | | | |
|---|---|---|---|---|
| 8,191,325 | B2 | 6/2012 | Ting | |
| 2003/0221381 | A1 | 12/2003 | Ting | |
| 2006/0016133 | A1 | 1/2006 | Speck | |
| 2007/0161345 | A1* | 7/2007 | Chato | 454/196 |
| 2009/0199498 | A1 | 8/2009 | Ting | |

* cited by examiner

INTERMEDIATE DIVIDER WITHIN AN EXTERIOR WALL UNIT

CROSS-REFERENCE TO RELATED APPLICATIONS

This application claims the benefit of U.S. Provisional Application No. 61/769,036, filed Feb. 25, 2013, and which is hereby incorporated by reference in its entirety.

FIELD OF THE INVENTION

This invention relates to building envelope system design applicable to exterior wall design such as a curtain wall system or a window wall system.

BACKGROUND OF THE INVENTION

The major functions of an exterior wall include the aesthetic design provided by the project architect and the interior environmental protection design provided by the exterior wall system designer or supplier. It is well recognized in the industry that wind load resistance and water-tightness performance are the two most important functions in the interior environmental protection design. Since an exterior wall is formed from many wall panels, there are many horizontal and vertical panel joints known as the grid lines in the exterior wall. The grid line design becomes a major feature in the aesthetic design created by the architect. Therefore, the architect demands as much freedom as possible for creating the grid line design. However, the grid line design has major functional impacts, most notably on wind load resistance and water-tightness performance as explained as follows.

In consideration of erection costs and field quality control problems, the unitized panel system has gained overwhelming popularity in the industry in recent years. For a conventional unitized curtain wall system, a wall unit may span the height of one floor with split vertical mullions anchored at each floor slab. In this arrangement, the vertical grid line along the split mullion must be continuous from the bottom to the top and the horizontal grid line near the anchoring location must be continuous around the building.

For an Airloop curtain wall system, a unit may span between two adjacent continuous vertical whole mullions and is supported on the mullions. In this arrangement, the vertical grid line along a mullion must be continuous from the bottom to the top but the architect will have freedom in designing the horizontal grid line arrangement.

For a conventional unitized or Airloop window wall system, a unit may span between floor slabs with a split mullion and be supported by a horizontal base and ceiling tracks. In this arrangement, the horizontal grid lines along the base and ceiling tracks must be continuous around the building and the vertical grid lines can be offset from floor to floor.

The above grid line limitations are required due to considerations of wind load resistance. It is highly desirable to provide freedom for an architect in designing the grid line arrangement within a wall unit. Systems that do not allow for division within a wall unit are limited in their ability to allow for flexibility in designing the grid line pattern. For example, if the architect desires a grid line pattern with alternating narrow and wide panels as an exterior aesthetic feature, then the uneven mullion spacings would look odd from the interior. In addition, incorporation of the narrow units would result in major cost increases.

Therefore, grid line design freedom may be provided within a wall unit with horizontal and/or vertical dividers.

However, the intersection points of the members including dividers and the perimeter frame members of the unit often become vulnerable to water leakage. For example, in most typical design conditions, the unit width is much smaller than the unit height; therefore, for wind load resistance, it is best for the horizontal divider to be continuous between the jamb frames of the unit and the vertical divider to be discontinuous at the horizontal divider. However, for water-tightness performance, it is best for the vertical divider to be continuous for easy downward water drainage. This presents a difficult decision to be made between the two options. In addition, once the choice has been made, there is no aesthetic freedom of choice for the intersection points.

In addition, the horizontal and/or vertical dividers create additional member intersection points which are vulnerable to water leakage due to the need for corner caulking and questionable long-term corner sealing integrity caused by joint stresses produced by thermal, wind, and seismic loads.

SUMMARY OF THE INVENTION

The objectives of the invention include the following items

1. The first objective of the invention is to provide an intermediate divider system within a wall unit with independent functions for wind load resistance and water-tightness performance such that the best conditions of the two functions can be achieved.
2. The second objective of the invention is to provide aesthetic design freedom while maintaining the above objective.
3. The third objective of the invention is to provide a caulk-free exterior corner joint at each member intersection point of all intermediate dividers.

DESCRIPTION OF PREFERRED EMBODIMENTS OF THE INVENTION

The present invention provides for an intermediate divider system within an exterior Airloop wall unit. Airloop exterior wall systems are known generally described in references including U.S. Pat. Nos. 5,452,552 and 6,393,778. The intermediate divider system of the present invention permits division of wall units, providing aesthetic design freedom for the wall grid line pattern.

In a preferred embodiment of the invention, optimal water-tightness and optimal wind load resistance are achieved by the arrangement of vertical and horizontal dividers and glazing beads. A typical wall unit has a height greater than the width. If a wall unit is divided with horizontal and vertical intermediate dividers, optimal wind load resistance is achieved by using a continuous intermediate horizontal divider with intermediate vertical dividers terminating at the horizontal divider, because the continuous divider spans the shorter dimension.

A continuous vertical element, however, provides better water-tightness performance because a continuous vertical element allows for better downward water drainage. As further described through the below discussion of the drawings, a preferred embodiment of the invention allows for both a continuous horizontal divider to provide optimal wind load resistance and a continuous vertical glazing bead to provide optimal water-tightness performance. Water-tightness performance is maintained by integrating an Airloop system of the intermediate dividers into the Airloop system of the wall unit perimeter frame members.

Figure 1:
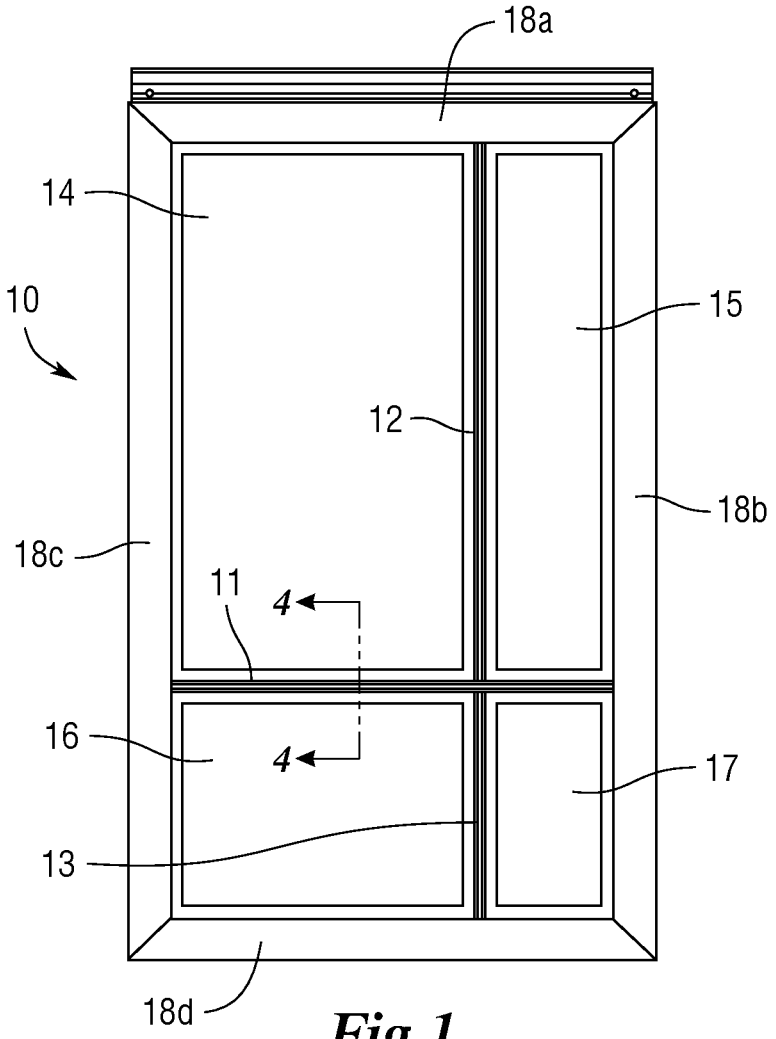
FIG. 1 shows the front view of a typical exterior wall unit of the present invention having four separate facing panes placed in four separate glazing pockets created by one horizontal divider and two vertical dividers terminated at the horizontal divider before the application of the exterior glazing members.

FIG. 1 shows the front view of a typical exterior wall unit 10 having four perimeter frame members 18*a*, 18*b*, 18*c*, 18*d* of the present invention before the application of exterior glazing beads. The wall unit 10 has a height being larger than the width and is separated into four quarters by a continuous intermediate horizontal divider 11 and two separated intermediate vertical dividers 12 and 13 terminating at the horizontal divider 11. This arrangement is the best for wind load resistance since the continuous divider spans the shorter dimension. If the height of the wall unit 10 is lesser than the width, a continuous vertical divider with two separated horizontal dividers would be chosen for the consideration of wind load resistance. As shown, the two separated vertical dividers 12 and 13 are positioned on the same vertical line while they can be off-set by design. In addition, any number of continuous dividers and any number of discontinuous dividers between the adjacent members including continuous dividers and perimeters can be used and all perimeter members and dividers do not need to be either horizontal or vertical. The vertical and horizontal dividers may be connected using any of a variety of well-known means, such as connection clips, screws, or welding. The wall unit 10 can assume any shape with at least one perimeter member as long as the wall unit is designed for forming a sealed joint with other wall units and for securing to a wall supporting structure. For example, one perimeter member can be bent into a circle to form a wall unit. As shown in FIG. 1, four different facing panes 14, 15, 16, and 17 are placed into the four separated quarters ready for exterior glazing application.

Figure 2:
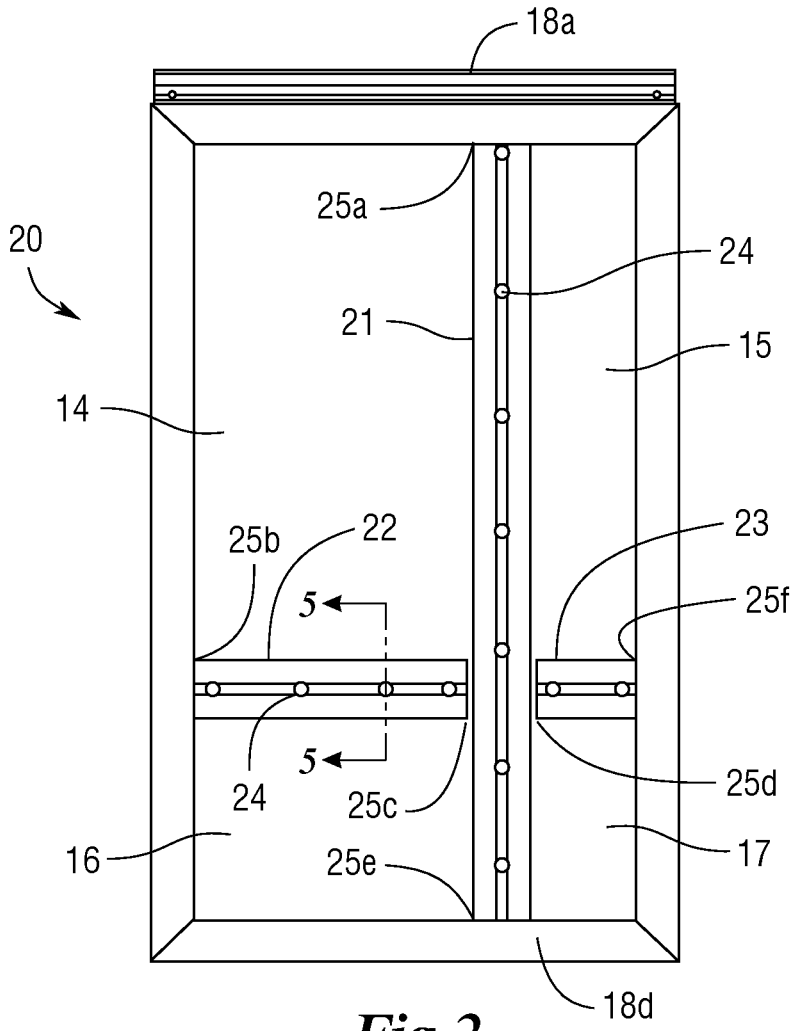
FIG. 2 is the front view of the wall unit of FIG. 1 after the application of exterior glazing beads on all members showing a continuous vertical glazing bead on the vertical dividers and two separated horizontal glazing beads terminated at the vertical glazing bead.

FIG. 2 shows the front view of a wall unit 20 after the application of exterior glazing beads on a wall unit 10 shown in FIG. 1. As shown, a continuous vertical glazing bead 21 spanning from the top perimeter frame 18*a* to the bottom perimeter frame 18*d* is secured to the separated vertical dividers 12 and 13 (shown on FIG. 1) with multiple fasteners 24 to provide structural support and exterior sealing functions at the vertical edges of facing panes 14, 15, 16, and 17 along the line of the vertical dividers 12 and 13 (shown on FIG. 1). As shown, two discontinuous glazing beads 22 and 23 terminated at the vertical glazing bead are secured to the continuous horizontal divider 11 (shown on FIG. 1) with multiple fasteners 24 to provide structural support and exterior sealing functions at the horizontal edges of facing panes 14, 15, 16, and 17 along the line of the continuous horizontal divider 11 (shown on FIG. 1). This arrangement is best for water-tightness performance since a continuous vertical sealant line will help to direct any infiltrated water downwardly to the bottom frame member 18*d* for eventual water drainage. The above demonstrates that the best sealing arrangement (i.e., continuous vertical glazing bead) is independent of the best structural arrangement (i.e., continuous horizontal divider).

Figure 3:
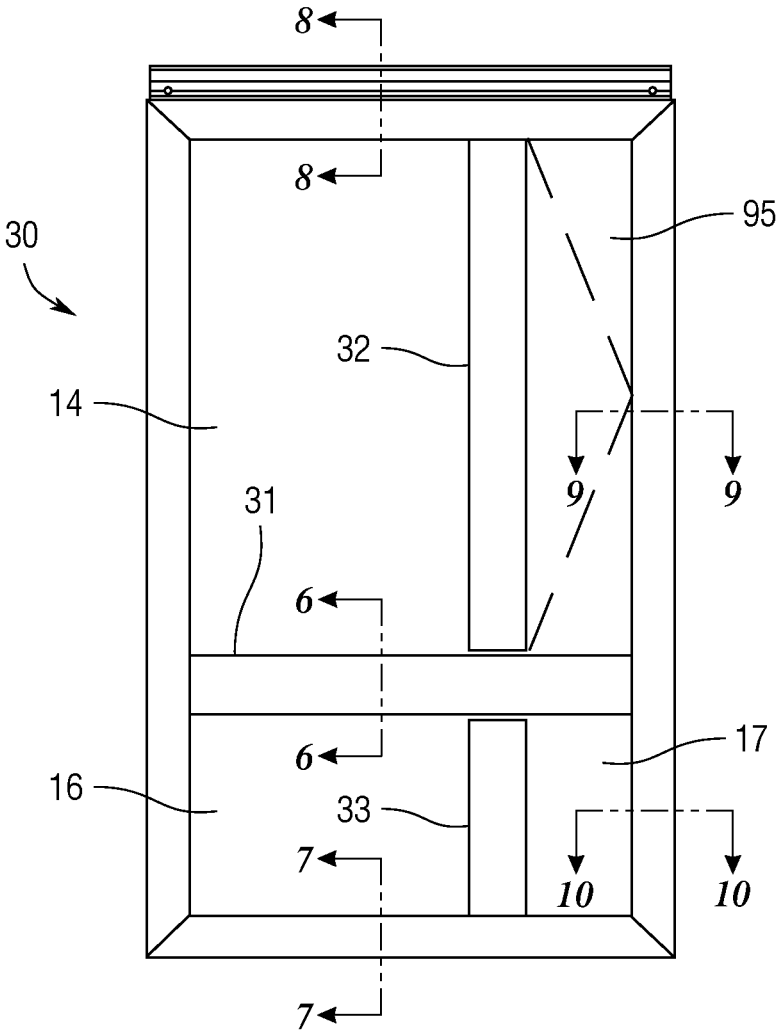
FIG. 3 is the front view of the wall unit of FIG. 2 after the application of aesthetic snap-on covers on all glazing beads showing a continuous horizontal snap-on cover along the horizontal divider and two separated snap-on covers terminated on the horizontal snap-on cover. This represents the finished wall unit.

FIG. 3 shows the front view of the finished wall unit 30 after the application of aesthetic snap-on covers on all glazing beads shown on FIG. 2. For illustration purposes, a typical Airloop wall unit is selected with insulated glass for facing panes 14, 16, 17 and an operable window unit 95 for the fourth facing pane. As shown, a continuous horizontal snap-on cover 31 is used on the separated horizontal glazing beads 22, 23 (shown on FIG. 2) and two separated vertical snap-on covers 32 and 33 are used on the continuous vertical glazing bead 21 (shown on FIG. 2). An architect may choose to instead apply a continuous snap-on cover in the vertical direction with separated horizontal snap-on covers. This demonstrates the present invention's ability to provide freedom for the aesthetic arrangement of vertical and horizontal members.

Figure 4:
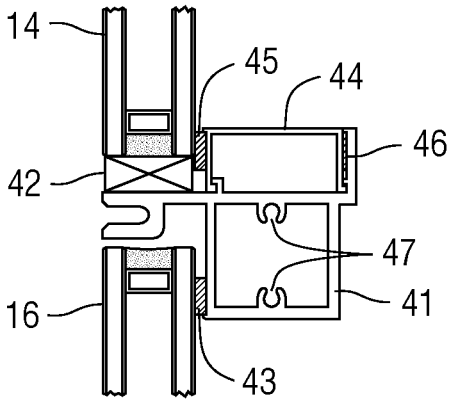
FIG. 4 is the fragmental cross-section taken along Line 4-4 of FIG. 1.

FIG. 4 is a fragmental cross-section taken along line 4-4 of FIG. 1. The weight of the top facing pane 14 is supported by a continuous horizontal divider 41 with a setting block 42. The bottom facing pane 16 is separated from the top facing pane 14 by the divider 41 with a horizontal interior glazing tape 43 to provide an air seal between the facing pane 16 the divider 41. The divider 41 has a wider glazing pocket on the top side to allow the glazing of various thicknesses of facing pane 14. As shown for illustration purposes only, the facing panes 14 and 16 are insulated glass with the same thickness. The interior glazing tape 45 is installed with the interior glazing bead 44 to provide an air seal between top facing pane 14 and interior glazing bead 44. Additional interior glazing tape 46 is used to provide an air seal between interior glazing bead 44 and divider 41. Facing panes of different thicknesses can be accommodated by changing the width of the interior glazing bead 44. Since the horizontal divider 41 must support the weight of the facing pane 14 above, fastener pockets 47 are provided for structural connections to the jamb frames 18*b* and 18*c* (shown on FIG. 1).

Figure 5:
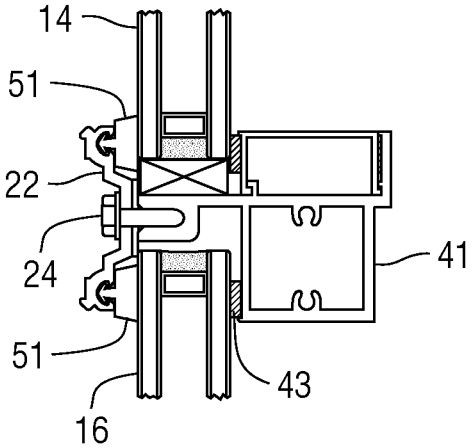
FIG. 5 is the fragmental cross-section taken along Line 5-5 of FIG. 2.

FIG. 5 is a fragmental cross-section taken along line 5-5 of FIG. 2. The exterior glazing bead 22 with two compressive gaskets 51 is secured to the horizontal divider 41 with spaced apart fasteners 24 to structurally capture the ends of facing panes 14 and 16, as well as to provide an exterior water seal along the ends of facing panes 14 and 16. The glazing beads 21 and 23 (shown in FIG. 2) are secured in a similar manner.

Figure 6:
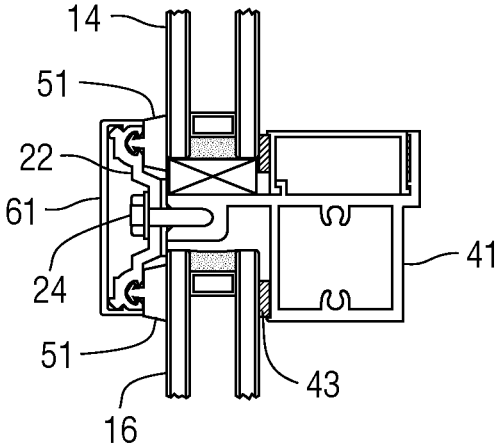
FIG. 6 is the fragmental cross-section taken along Line 6-6 of FIG. 3.

FIG. 6 is a fragmental cross-section taken along line 6-6 of FIG. 3. The continuous cover 61 is snapped onto the glazing beads 22 and 23 (shown on FIG. 2). Since it is continuous over the vertical glazing bead 21 (shown on FIG. 2), notching on glazing beads 22 and 23 (shown in FIG. 2), and/or the cover 61 will be required to prevent interference. The snap-on covers 32 and 33 (shown on FIG. 3) are installed in a similar manner.

With reference to FIG. 2, six additional member intersection points, 25*a*, 25*b*, 25*c*, 25*d*, 25*e*, and 25*f* are created by the exterior glazing beads 21, 22, and 23. If a conventional unitized system were used, these six additional intersection points would be critical seal locations that require sealing by caulking or other means. No matter how much care is exercised in executing the application of these critical seals in the shop, water leakage caused by a critical seal failure is a matter of time due to joint stresses produced by thermal, wind, and seismic loads, and aging of the sealing material. However, if an Airloop wall unit is used, there is no need for sealing these six additional intersection points as explained in the following description.

Figure 7:
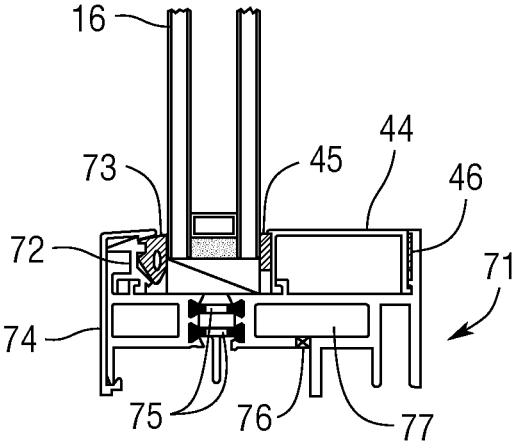
FIG. 7 is the fragmental cross-section taken along Line 7-7 of FIG. 3.

FIG. 7 is a fragmental cross-section taken along line 7-7 of FIG. 3. The member 71 is a typical sill frame of an Airloop wall unit. The functions of interior glazing bead 44, interior glazing tape 45, and additional interior glazing tape 46 are explained in the description of FIG. 4. The exterior glazing bead 72 with exterior gasket 73 is provided to structurally capture the facing pane 16. Exterior gasket 73 forms a water seal between the facing pane 16 and the exterior glazing bead 72. For aesthetic purposes, a snap-on cover 74 is provided on exterior glazing bead 72. Multiple air entry holes 75 are provided to allow the pressure equalization of the Airloop around the perimeter frame of the wall unit 30 (shown in FIG. 3). The holes 75 will also perform a secondary function of draining water that incidentally infiltrates into the Airloop due to imperfection in the water sealing gasket 73. A small air hole 76 is also provided to pressure-equalize the sub-Airloop 77.

Figure 8:
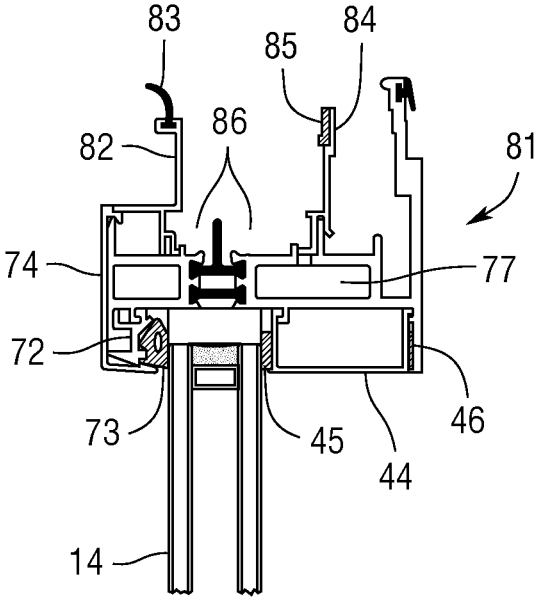
FIG. 8 is the fragmental cross-section taken along Line 8-8 of FIG. 3.

FIG. 8 is a fragmental cross-section taken along line 8-8 of FIG. 3. The member 81 is a typical head frame of an Airloop wall unit. The functions of interior glazing bead 44, interior glazing tape 45, and additional interior glazing tape 46 are explained in the description of FIG. 4. The functions of exterior glazing bead 72, exterior gasket 73, snap-on cover 74, and sub-Airloop 77 are explained in the descriptions of FIG. 7. A panel joint is formed when the sill frame 71 (shown in FIG. 7) of the upper wall unit is inter-locked with the head frame 81 of the lower wall unit. The horizontal rain screen member 82 with a wipe gasket 83 is utilized to repel the majority of wind driven water impacting on the panel joint (not shown), and is in contact with the vertical rain screen element (not shown) on the wall supporting Airloop mullion (not shown). Member 84 is a horizontal water seal member with a water seal 85 near the end which is married to the water seal element (not shown) on the supporting Airloop mullion (not shown). In this arrangement, the panel joint cavities in conjunction with the vertical joint cavities created by the Airloop mullions produces the external pressure-equalized outer Airloop around each Airloop wall unit. Since a small amount of water infiltration into the outer Airloop is expected due to dynamic air entry through the wipe gasket 83, two gutter channels 86 with no end dams are provided to instantaneously drain the water down and out at the vertical joint with the Airloop mullion (not shown).

Figure 9:
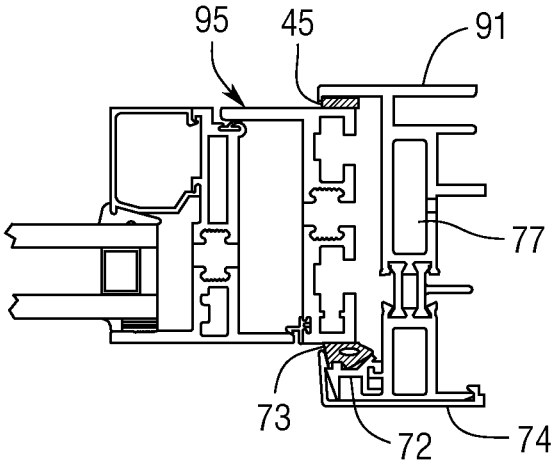
FIG. 9 is the fragmental cross-section taken along Line 9-9 of FIG. 3.

FIG. 9 is a fragmental cross-section taken along line 9-9 of FIG. 3, showing incorporation of an operable window unit 95. The maximum space is created to glaze in the depth of the window unit. As shown is the condition at the jamb perimeter frame 18*b* (shown on FIG. 1). Reviewing the shapes of the head frame 81 (shown on FIG. 8), the cross-section shown on FIG. 6, and using same profile of divider 41 (shown in FIG. 4) for the vertical divider 12 (shown on FIG. 1), it can be easily understood that a uniform space is created around all four sides of the window unit to glaze in the window unit.

Figure 10:
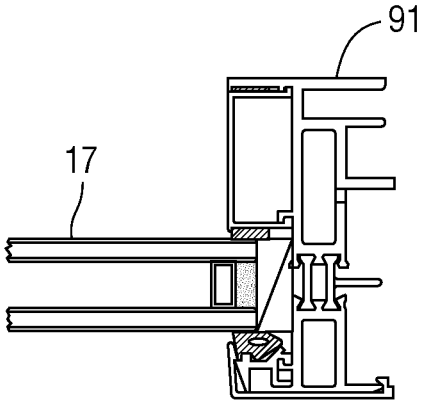
FIG. 10 is the fragmental cross-section taken along Line 10-10 of FIG. 3.

FIG. 10 is a fragmental cross-section taken along line 10-10 of FIG. 3. The jamb frame 91 with the facing pane 17 has the same components as described for FIG. 7, except there is no air hole in the member.

Based on the Airloop Principle, to prevent water leakage problems, a pressure-equalized Airloop must be formed around the perimeter of each facing pane; therefore, a sub-Airloop around each of facing panes 14, 15, 16, and 17 (shown on FIG. 3) must be pressure equalized. The most convenient way to allow air entry from the Airloop around the perimeter frame members into the vertical and/or horizontal dividers is by not sealing the intersection points 25*a*, 25*b*, 25*c*, 25*d*, 25*e*, and 25*f* (shown on FIG. 2). Therefore, the present invention can provide a caulk-free exterior corner joint at each member intersection point of all intermediate dividers.

Nothing in the above description is meant to limit the present invention to any specific materials, geometry, or orientation of elements. Many modifications are contemplated within the scope of the present invention and will be apparent to those skilled in the art. The embodiments described herein were presented by way of example only and should not be used to limit the scope of the invention.

The invention claimed is:

1. An airloop exterior wall system formed from individual framed wall units comprising a perimeter frame and an intermediate wall divider system, wherein said intermediate wall divider system comprises a horizontal divider, a vertical divider, wherein said perimeter frame, said horizontal divider, and said vertical divider form a lag zing pocket for a facing pane, wherein said facing pane is secured in said glazing pocket by a horizontal glazing bead fastened to said horizontal divider and a vertical glazing bead fastened to said vertical divider, wherein the space between the perimeter of said facing pane and said perimeter frame, said horizontal divider, and said vertical divider is pressure equalized with exterior air.

2. The exterior wall system of claim 1, wherein one of said horizontal divider and said vertical divider is a continuous divider with both ends terminating at opposite sides of said perimeter frame.

3. The exterior wall system of claim 1, wherein said individual framed wall units comprise a plurality of horizontal dividers.

4. The exterior wall system of claim 1, wherein said individual framed wall units comprise a plurality of vertical dividers.

5. The exterior wall system of claim 1, wherein said facing pane is an operable window.

6. An airloop exterior wall unit comprising:

a perimeter frame and an intermediate wall divider system, wherein said intermediate wall divider system comprises a horizontal divider, a vertical divider, wherein said perimeter frame, said horizontal divider, and said vertical divider form a lag zing pocket for a facing pane, wherein said facing pane is secured in said glazing pocket by a horizontal glazing bead fastened to said horizontal divider and a vertical glazing bead fastened to said vertical divider, wherein the space between the perimeter of said facing pane and said perimeter frame, said horizontal divider, and said vertical divider is pressure equalized with exterior air.

7. The exterior wall unit of claim 6, wherein one of said horizontal divider and said vertical divider is a continuous divider with both ends terminating at opposite sides of said perimeter frame.

8. The exterior wall unit of claim 6, comprising a plurality of horizontal dividers.

9. The exterior wall unit of claim 6, comprising a plurality of vertical dividers.

10. The exterior wall unit of claim 6, wherein said facing pane is an operable window.

* * * * *

UNITED STATES PATENT AND TRADEMARK OFFICE

CERTIFICATE OF CORRECTION

PATENT NO. : 9,051,732 B2
APPLICATION NO. : 14/188848
DATED : June 9, 2015
INVENTOR(S) : Raymond M. L. Ting It is certified that error appears in the above-identified patent and that said Letters Patent is hereby corrected as shown below:

| | | | |
|---|---|---|---|
| Column 6 | Line 29 | Claim 1 | Change “lag zing” to “glazing” |
| Column 6 | Line 58 | Claim 6 | Change “lag zing” to “glazing” |

Signed and Sealed this
Twenty-sixth Day of July, 2016

Michelle K. Lee

Michelle K. Lee
*Director of the United States Patent and Trademark Office*